US005551322A

United States Patent [19]

Mikic et al.

[11] Patent Number: 5,551,322

[45] Date of Patent: Sep. 3, 1996

[54] SPEED WRENCH

[75] Inventors: Frank Mikic; Jeffrey H. Hoff, both of Kenosha, Wis.

[73] Assignee: Snap-on Technologies, Inc., Crystal Lake, Ill.

[21] Appl. No.: 510,295

[22] Filed: Aug. 2, 1995

Related U.S. Application Data

[63] Continuation of Ser. No. 276,519, Jul. 11, 1989, abandoned, which is a continuation of Ser. No. 102,504, Aug. 5, 1993, abandoned, which is a continuation of Ser. No. 917,363, Jul. 23, 1992, abandoned.

[51] Int. Cl.[6] ..... B25B 13/08

[52] U.S. Cl. ..... 81/186; 81/119; 81/170

[58] Field of Search ..... 81/119, 186, 165, 81/166, 167, 170, 121.1, 124.3

[56] References Cited

U.S. PATENT DOCUMENTS

| | | | |
|---|---|---|---|
| 736,687 | 8/1903 | Chandler . | |
| 834,807 | 10/1906 | Hoffmann . | |
| 1,551,763 | 9/1925 | Morris . | |
| 1,557,864 | 10/1925 | Mull . | |
| 1,954,141 | 4/1934 | Miguelon | 81/119 |
| 2,232,259 | 3/1941 | Morgan . | |
| 2,652,735 | 3/1949 | Wilder . | |
| 2,657,606 | 11/1953 | Finn . | |
| 2,671,368 | 3/1954 | Diebold . | |
| 2,692,523 | 10/1954 | Finn . | |
| 2,704,004 | 3/1955 | Johnson . | |
| 2,846,912 | 8/1958 | Day . | |
| 3,242,775 | 3/1966 | Hinkle . | |
| 3,602,073 | 8/1971 | Siwersson . | |
| 3,757,614 | 9/1973 | Evans et al. . | |
| 3,762,244 | 10/1973 | Evans . | |
| 3,785,226 | 1/1974 | Ward . | |
| 3,881,377 | 5/1975 | Evans et al. . | |
| 3,916,735 | 11/1975 | Evans . | |
| 3,921,476 | 11/1975 | Evans | 81/119 |
| 4,011,778 | 3/1977 | Delin . | |
| 4,167,882 | 9/1979 | Siwersson . | |
| 4,776,244 | 10/1988 | Olson et al. . | |
| 4,889,020 | 12/1989 | Baker . | |
| 5,117,714 | 6/1992 | Pagac et al. | 81/119 |

FOREIGN PATENT DOCUMENTS

| | | |
|---|---|---|
| 3886 | 8/1882 | United Kingdom . |
| 29246 | 8/1910 | United Kingdom . |

*Primary Examiner*—D. S. Meislin
*Attorney, Agent, or Firm*—Emrich & Dithmar

[57] ABSTRACT

A speed wrench has a short jaw and a long jaw interconnected by a throat, the jaws respectively having short and long driving surfaces which are generally parallel but which may be very slightly inclined with respect to each other. The throat has a generally flat surface portion adjacent to the short driving surface and inclined at an angle of at least 120° thereto and connected thereto by an arcuate recess in the short jaw. This generally flat surface portion may be slightly convex having a radius greater than twice the distance between the driving surfaces. The remainder of the throat is arcuate and is shaped and dimensioned so that it will not contact a fastener engaged with the driving surfaces. Open-end wrench and adjustable wrench versions are disclosed, and in the former the support surface portion of the throat has a length approximately one-half the side dimension of an associated fastener. In the adjustable wrench version, at least the long driving surface may be serrated.

13 Claims, 2 Drawing Sheets

SPEED WRENCH

This is a continuation of application Ser. No. 276,519, filed Jul. 18, 1994, which is a continuation of Ser. No. 102,504, filed Aug. 5, 1993, which is a continuation of Ser. No. 917,363, filed Jul. 23, 1992, all abandoned.

BACKGROUND OF THE INVENTION

1. Field of the Invention

This invention relates in general to wrenches of the type commonly known as "speed wrenches" which provide a ratcheting-type action.

2. Description of the Prior Art

The prior art includes a number of different designs of wrenches which provide a ratchet-type action without the use of any ratchet wheel or dog or other additional moving parts to provide the ratcheting action. Such wrenches are commonly referred to as "speed wrenches" and are typically characterized by jaws respectively having long and short driving surfaces for respectively engaging opposite sides or flats of an associated fastener, such as a hexagonal fastener. Both open-end wrench and adjustable wrench versions of such ratcheting-type speed wrenches have been provided. In operation, when the wrench is rotated in a forward torque applying direction, the driving surfaces will firmly grip the fastener for applying torque to it, while when the wrench is rotated in the reverse direction the driving surfaces will slip or "ratchet" over the fastener surfaces to facilitate movement of the wrench to engagement with a different set of fastener flats without having to lift the wrench from the fastener.

A common prior art speed wrench configuration is designated by the numeral 10 in FIGS. 1 and 2 and includes long and short driving surfaces 11 and 12 interconnected by a generally V-shaped throat which includes flat throat surfaces 13 interconnected by an arcuate corner recess 14. Such recesses 14 may also be provided at the junctions between the throat surfaces 13 and the driving surfaces 11 and 12. The wrench 10 is illustrated as used with a hexagonal fastener 15 having six flats or side surfaces 16 interconnected at six equal-angle corners 17. The wrench 10 is designed so that when an appropriately-sized fastener 15 is disposed between the jaws, the corner recesses 14 will provide clearance for the fastener corners 17. Ideally, if both the wrench 10 and the fastener 15 are accurately sized, the fastener 15 will fit snugly between the wrench jaws and the fastener corners 17 will remain in the corner recesses 14 during a torque applying operation.

Such prior speed wrenches work satisfactorily when the wrench is properly sized for the fastener with which it is being used. However, in practice, fasteners are manufactured to relatively wide tolerances, resulting in considerable variation in the dimensions of fasteners which are nominally of the same size. To a lesser extent, there are also tolerance variations in the spacing between driving surfaces of open-end wrenches of the same nominal size. As a result, there may be considerable clearance or play between the fastener and a wrench which is nominally of the proper size for that fastener. It is not uncommon for this play to be such that it is necessary to rotate the wrench through an angle of as great as 10° before bringing the driving surfaces into firm torque applying engagement with the fastener flats.

When, because of tolerance variations in the parts, the wrench 10 must be rotated through several degrees in order to bring the driving surfaces 11 and 12 into firm torque applying engagement with opposed fastener flats 16, the corner 17 disposed in the wrench throat will ride up out of the corner recess 14 in the throat and onto the adjacent throat surface 13, as can be seen in FIG. 2. This creates a camming action between the throat surface 13 and the fastener corner 16 which tends to urge the fastener 15 outwardly away from the throat. Thus, the short driving surface 12 is slid down closer to the adjacent corner of the fastener and, if this relative rotation between the wrench 10 and the fastener 15 continues far enough, the short driving surface 12 will slip off the fastener. Even if firm gripping action with the fastener is achieved, the short driving surface 12 will be gripping the adjacent fastener flat 16 closer to the corner and will tend to wear or deform the corner more readily, as indicated at 18 in FIG. 2, further exacerbating the tendency to slip during a torque applying operation. The net result is that the ultimate torque which can be applied to the fastener 15 is greatly reduced.

SUMMARY OF THE INVENTION

It is a general object of the invention to provide an improved speed wrench which avoids the disadvantages of prior speed wrenches while affording additional structural and operating advantages.

An important feature of the invention is a speed wrench which significantly increases the ultimate torque which can be applied by the wrench.

In connection with the foregoing feature, another feature of the invention is the provision of a speed wrench which maintains consistent fastener engagement and torque application despite tolerance variations in fastener size.

Still another feature of the invention is the provision of a speed wrench of the type set forth which inhibits slippage of the wrench from an associated fastener during a torque applying operation.

Yet another feature of the invention is the provision of a speed wrench of the type set forth which minimizes damage to the corners of an associated fastener.

Still another feature of the invention is the provision of an open-end speed wrench of the type set forth.

Yet another feature of the invention is the provision of an adjustable speed wrench of the type set forth.

These and other features of the invention are attained by providing a wrench for use with a fastener having a plurality of substantially flat sides intersecting at a plurality of corners, the wrench comprising: a wrenching head including two jaws and a throat interconnecting the jaws, the jaws respectively including driving surfaces respectively disposed for driving engagement with opposed sides of the fastener, the throat including a generally flat first surface portion adjacent to one of the driving surfaces and inclined with respect thereto at a predetermined angle of at least 120° and disposed for engagement in use with a corner of the fastener, the throat including a recessed second surface portion interconnecting the first surface portion and the other of the driving surfaces and shaped and dimensioned so as to remain spaced in use from an associated fastener which is engaged with the driving surfaces.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
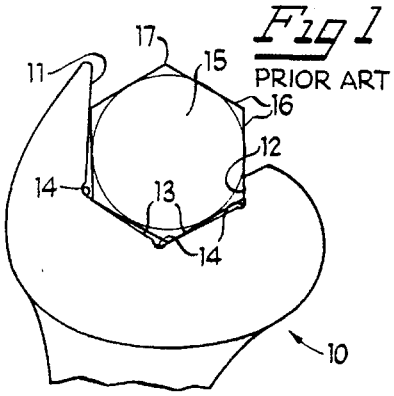
Fig 1 PRIOR ART
FIG. 1 is a fragmentary plan view of a prior art open-end speed wrench, shown with an associated fastener at the beginning of a torque applying operation.

Referring to FIGS. 3–6, there is illustrated an open-end speed wrench, generally designated by the numeral 20, constructed in accordance with a first embodiment of the present invention. The wrench 20 includes a handle or shank 21 provided with a wrenching head 22 at the end thereof. It will be appreciated that another wrenching head could be provided at the other end of the handle (not shown). The wrenching head 22 has a short jaw 23 and a long jaw 24, respectively having substantially flat planar driving surfaces 25 and 26 thereon and respectively terminating at the outer or distal ends thereof in truncated angled ends 27 and 28. The driving surface 25 is substantially shorter than the driving surface 26 and, at the inner end thereof, intersects a short arcuate recess 29. The driving surfaces 25 and 26 are spaced apart a distance W slightly greater than the nominal across-sides dimension X of an associated hexagonal fastener 15 of the size for which the wrench 20 is intended to be used. The driving surfaces 25 and 26 are generally parallel, but they may slightly converge outwardly at a small angle of approximately 3° to improve the flat engaging contact with the opposite sides of an associated fastener 15 despite tolerance size variations in the fastener. The length of the short driving surface 25 is long enough to ensure adequate gripping of the fastener 15 during forward rotation and short enough to ensure ratcheting slippage during reverse rotation, and is typically approximately one-tenth the across sides dimension X of the fastener 15.

The wrench head 22 has a throat 30 which interconnects the jaws 23 and 24. The throat 30 includes a generally flat support surface portion 31 which extends from the arcuate recess 29 downwardly away from the driving surface 25. More specifically, the support surface portion 31 is inclined with respect to the driving surface 25 at an angle Z in the range of from about 120° to about 140° and, preferably, approximately 123°. While the support surface portion 31 may be a flat planar surface, in the preferred embodiment it is very slightly convex for ease of manufacturing, having a large radius R which is more than twice the distance W between the driving surfaces 25 and 26. The support surface portion 31 terminates at an inner end 32 and has a length L which is substantially less than the nominal side dimension S of the associated fastener 15. In particular, the length L may be in the range of from about ⅓ to about ⅔ the fastener side dimension S and is preferably approximately ½ S, i.e., substantially 0.29 W.

The throat 30 also includes an arcuate portion 35 which extends from the inner end 32 of the support surface portion 31 to the inner end of the driving surface 26. While the arcuate portion 35 may have any desired shape, in the preferred embodiment, it is a compound surface including a relatively small radius portion 36 and a relatively large radius portion 37, so that the arcuate portion 35 slopes more steeply away from the support surface 31. The essential aspect of the arcuate portion 35 is that it be so dimensioned and shaped that it will not contact the associated fastener 15 in use, as will be explained in greater detail below.

Figure 4:
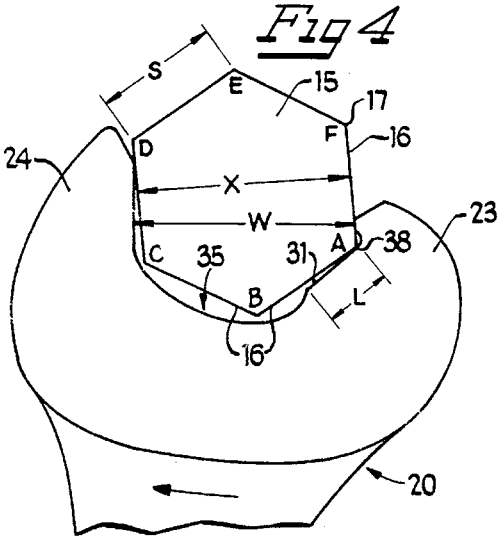
FIG. 4 is a reduced view similar to FIG. 3, illustrating the wrench thereof with an associated fastener at the beginning of the torque applying operation.

In operation, when it is desired to torque a fastener 15, the wrench 20 is applied to the fastener 15 in the manner illustrated in FIG. 4 in which, to facilitate the description, the corners of the fastener 15 have been respectively designated A through F, lettered clockwise. The fastener 15 is received between the wrench jaws 23 and 24 until a corner A of the fastener 15 engages the support surface portion 31 of the throat 30 at point 38, with the driving surface 25 disposed in engagement with the adjacent one of the fastener flats 16. The opposite one of the fastener flats 16 will be disposed for engagement with the driving surface 26 at a location adjacent to the outer or distal end thereof, which location may be initially spaced a slight distance from the fastener, depending upon tolerance variations in the fastener size. In the latter case, it will be necessary to rotate the wrench 20 a few degrees clockwise to being the driving surface 26 into driving engagement with the adjacent flat of the fastener 15. It will be appreciated that, because the angle Z is preferably greater than the 120° angle between adjacent flats of the fastener 15, the fastener 15 will normally make only point contact with the support surface portion 31 at point 38.

Figure 5:
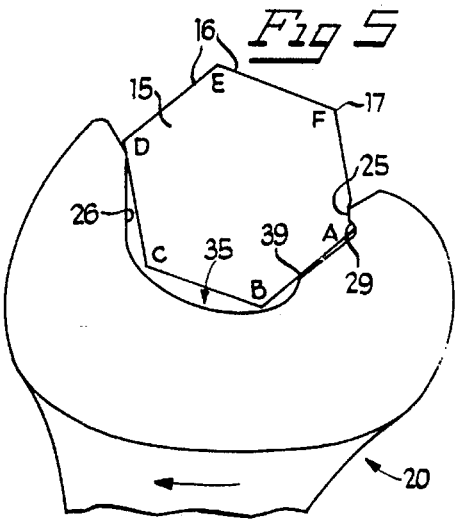
FIG. 5 is a view similar to FIG. 4, illustrating the parts during a high torque application.

It is a significant aspect of the invention that when the fastener 15 is thus disposed in point contact with the support surface portion 31, with the driving surfaces 25 and 26 respectively disposed in driving engagement with opposite flats 16 of the fastener 15, the arcuate portion 35 of the throat 30 will be out of contact with the fastener 15 and, more specifically will be spaced from the corners B and C of the fastener 15. Even in the case of an undersized fastener, where the rotation of the wrench 20 needed to bring the driving surface 26 into engagement with the adjacent fastener flat 16 is sufficient to move the support surface portion 31 into engagement with the flat between corners A and B, the depth and shape of the arcuate portion 35 is such that it will still be spaced from the corners B and C, as can be seen in FIG. 5.

Figure 6:
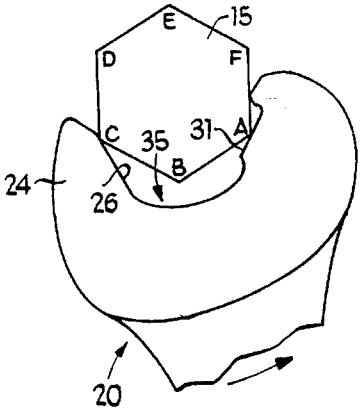
FIG. 6 is a view similar to FIG. 5, illustrating reverse or ratcheting rotation of the wrench.

In applying torque to the fastener 15, the wrench 20 is rotated further in a clockwise direction. In low torque applications, this will not result in any deformation of the fastener 15. After the fastener 15 has been rotated the desired amount, the wrench 20 is then rotated in a counterclockwise direction, as illustrated in FIG. 6, so that it will slip with respect to the fastener 15 in a ratcheting manner to reposition the wrench 20 at a new wrenching location, in a known manner. It is a significant aspect of the invention that the support surface portion 31 supports the corner A of the fastener 15 during the initial part of the rotation of the wrench 20 to a new wrenching location. When the corner A reaches the end of the support surface portion 31, the fastener 15 will be supported on the driving surfaces 25 and 26. Throughout the rotation of the wrench 20 to a new wrenching location, the arcuate portion 35 of the throat 30 remains out of contact with the fastener 15.

Thus, it will be appreciated that the length L of the support surface portion 31 must be great enough to provide support for the fastener corner A during reverse rotation through a sufficient angle to prevent lockup of the wrench 20 on the fastener 15. Yet the length L must be short enough so that the surface portion 31 will not come in contact with the corner B of the fastener or cause the arcuate portion 35 of the throat 30 to contact the corner B, during the torque application.

Also, the angle Z must be large enough, preferably at least 120°, so that it will not engage the flat of the fastener 15 between corners A and B too soon, and thereby start to push it out of the wrench before wrenching engagement of the driving surfaces 25 and 26 with the fastener 15 has been achieved. On the other hand, it is desirable that, during high torque applications, when the driving surfaces 25 and 26 distort the fastener 15 near the corners A and D, that the support surface portion 31 engage the fastener 15, as at 39 (FIG. 5), to provide an additional driving location. Thus, the angle Z should be small enough to permit this to happen. However, even in this event it will be appreciated that the arcuate portion 35 of the throat 30 remains spaced from the fastener corners B and C. In this regard, it will be appreciated that the corner recess 29 permits a clearance space for fastener material to flow as a result of deformation by the driving surface 25, as illustrated in FIG. 5.

In summary, the length L and the angle Z are compromises between adequate support for one fastener corner during reverse rotation, while ensuring clearance of the arcuate portion 35 of the throat from the fastener and good engagement of the jaws with the fastener flats during forward rotation.

Figure 2:
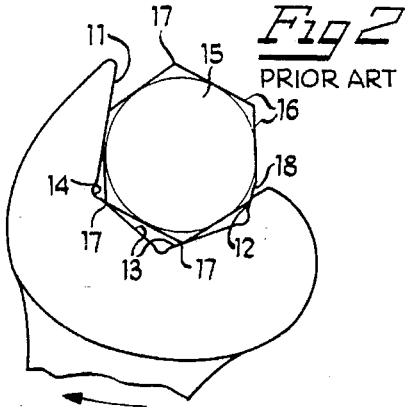
Fig 2 PRIOR ART
FIG. 2 is a view similar to FIG. 1, illustrating rotation of the wrench relative to the fastener during a torque applying operation as a result of size variations in the fastener.
Figure 3:
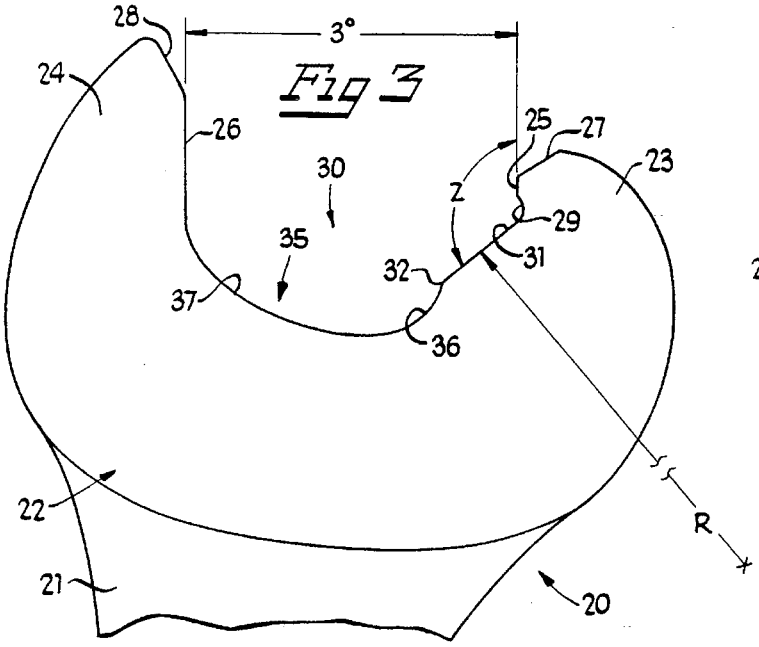
FIG. 3 is an enlarged view similar to FIG. 1 of an open-end speed wrench in accordance with the present invention.

It has been found that the above-described design of the wrenching head 22 results in dramatic improvement of the ultimate torque which can be applied by the wrench 20. More specifically, with fasteners of nominal size, the wrench 20 has achieved ultimate torques approximately twice those achieved with the prior art wrench 10 of FIGS. 1 and 2 and, with fasteners about 97% of nominal size, the wrench 20 has achieved ultimate torques approximately four times those achieved with the prior wrench 10 of FIGS. 1 and 2. It is a significant aspect of the invention that the fastener 15 will make single-point initial contact with the support surface 31 at point 38, despite tolerance variations in the size of the fastener 15.

Figure 7:
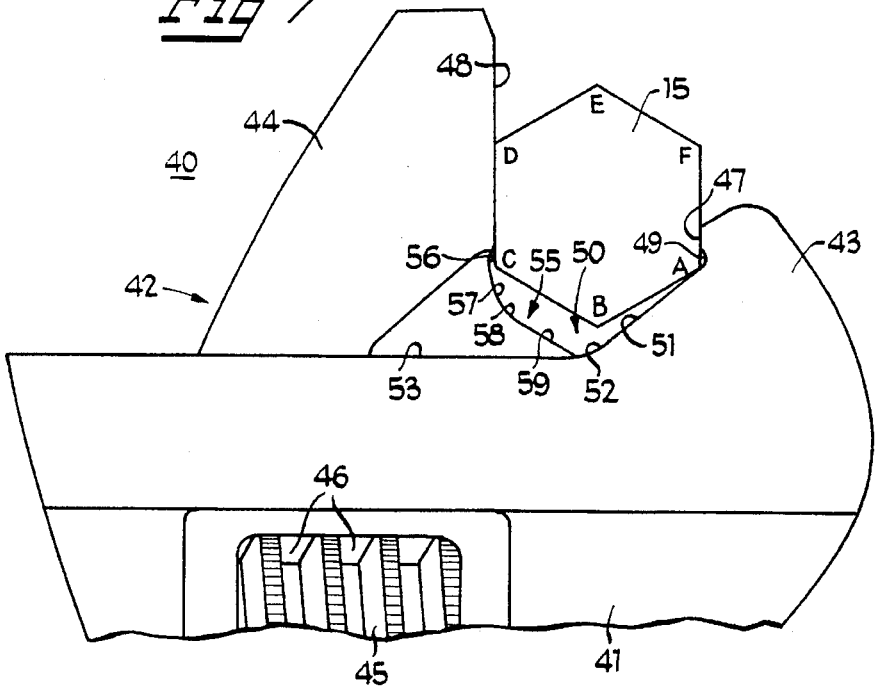
FIG. 7 is a fragmentary plan view of an adjustable speed wrench in accordance with the present invention, shown applied to the associated fastener.

Referring now to FIG. 7, there is illustrated an adjustable wrench 40 in accordance with another embodiment of the invention. The wrench 40 has a fixed or handle member 41 which supports a wrenching head 42 including a short jaw 43, unitary with the handle member 41, and a long jaw 44 on a separate member movable with respect to the handle member 41. The handle member 41 carries an adjustment worm 45 disposed for meshing engagement with teeth 46 on the jaw 44 for effecting adjusting movement thereof, in a known manner. Short and long driving surfaces 47 and 48 are, respectively, formed on the jaws 43 and 44 in facing relationship with each other. The driving surfaces 47 and 48 are flat, planar surfaces which are generally parallel. The inner end of the short driving surface 47 intersects a short arcuate recess 49.

The jaws 43 and 44 also cooperate to define a throat 50 which interconnects them. More specifically, the throat 50 includes a support surface 51 formed on the handle member 41 which slopes downwardly from the arcuate recess 49 toward the jaw 44. While the support surface 51 may be flat, in the preferred embodiment it is very slightly convex, having a large radius. The inner end of the support surface 51 is continuous with a short arcuate portion 52 which, in turn, leads into an elongated flat surface 53 which is disposed substantially perpendicular to the driving surface 47. The support surface 51 is inclined with respect to the driving surface 47 at an angle in the range of from about 130° to about 140° and, preferably, about 133°, in the same manner as was described above in connection with the wrench 20.

The throat 50 also includes a compound portion 55 formed on the jaw 44, which includes a short arcuate portion 56 extending from the inner end of the driving surface 48, a short straight portion 57, a larger-radius arcuate portion 58 and a straight portion 59. A significant aspect of the invention is that the throat 50 is so dimensioned and shaped that, in use, an associated fastener 15 does not contact any part of the throat 50 except for the support surface 51.

In use, a fastener 15 is inserted between the jaws 43 and 44 until a corner A of the fastener 15 is disposed in engagement with the support surface 51 and the driving surface 47 is disposed in engagement with the adjacent flat between the corners A and F of the fastener 15. The movable jaw 44 is then closed upon the fastener 15. In a typical application, the movable jaw 44 will be closed only to the point where the driving surface 48 is spaced a slight distance from the fastener 15 so that the wrench 40 must be rotated clockwise through a slight angle to bring the driving surface 48 into engagement with the adjacent flat of the fastener 15 between the corners C and D. This loose fit accommodates ratcheting counter rotation of the wrench 40 after a torque applying rotation, in a known manner. In will be appreciated that, in this use configuration, the throat 50 is out of contact with the corners B and C of the fastener 15.

The wrench 40 will be operated in the usual manner until the final torque applying rotation of the wrench 40, at which time the jaw 44 will be moved into tight clamping engagement with the fastener 15 in standard fashion, for the high-torque final torque applying rotation.

For purposes of illustration, the wrench 40 has been shown in FIG. 7 with an intermediate-size fastener 15 which has a side dimension approximately the same as the length of the support surface 51. This is because the support surface 51 has to be long enough to accommodate the maximum size fastener which can be handled by the adjustable wrench 40. It will be appreciated that the effective shape of the throat 30 will change in use, depending upon the size of the fastener 15 being wrenched, since the plane of the throat surface 59 will cross different ones of the throat surfaces 51–53 on the handle member 41, depending upon the distance between the driving surfaces 47 and 48. However, the fastener corners B and C will always remain out of contact with the throat 50.

The reverse ratcheting rotation of the wrench 40 to a new wrenching position operates in the same manner as was described above in connection with the wrench 20. It is a significant feature of the invention that the configuration of the throat 50 provides single-point initial contact of the fastener corner A with the support surface 51, irrespective of the size of the fastener 15 with which the adjustable wrench 40 is used.

Figure 8:
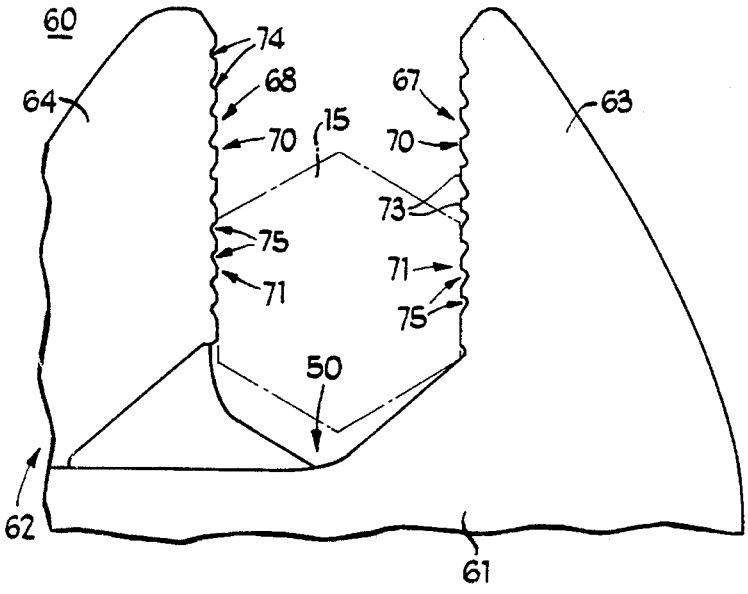
FIG. 8 is a fragmentary view similar to FIG. 7 of a modified form of adjustable speed wrench.
Figure 9:
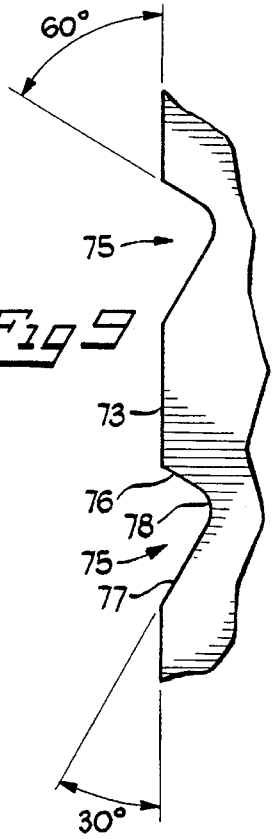
FIG. 9 is an enlarged fragmentary view of one of the driving surfaces of the wrench of FIG. 8.

Referring to FIGS. 8 and 9, there is illustrated another adjustable wrench 60 in accordance with the present invention, which includes a fixed handle member 61 which carries a wrenching head 62 including a fixed jaw 63 unitary with the handle member 61 and a movable jaw 64 adapted for movement relative to the jaw 63, in the same manner as was described above in connection with the adjustable wrench 40. The jaws 63 and 64, respectively, have driving surfaces 67 and 68 thereon which are generally parallel. Each of the driving surfaces 67 and 68 is serrated, having an upper serrated region 70 and a lower serrated region 71, each of which comprises a series of recesses or grooves spaced apart by coplanar lands 73. More specifically, the upper region 70 has recesses 74 and the lower region 71 has recesses 75, the recesses 74 and 75 being substantially identical in shape but being oriented differently.

Referring to FIG. 9, each of the recesses 75 has a 60° flat 76 and a 30° flat 77 disposed substantially perpendicular to each other and interconnected by an arcuate root 78. The recesses 75 are oriented so that the 30° flats 77 are disposed at the lower or inner end of the recess, while in the upper region 70, the recesses 74 are oriented so that the 30° flats 77 are disposed at the upper end of the recess.

The throat of the wrench 60 has the same configuration as that of the wrench 40 described above in connection with FIG. 7 and functions in the same manner. However, the serrated regions 70 and 71 on the jaws 63 and 64 reduce slippage between the jaws 63 and 64 and the fastener 15 and, thereby, further increase the ultimate torque which can be achieved with the wrench 60. While the driving surfaces 67 and 68 have been illustrated as having the same length, it will be appreciated that the jaw 63 and the driving surface 67 could be of the same configuration as the jaw 43 and driving surface 47 of the wrench 40 illustrated in FIG. 7 and, thereby, function as a speed wrench. In that case, the serrations would be formed only on the driving surface 68.

From the foregoing, it can be seen that there has been provided an improved wrench which has a uniquely-shaped throat which provides contact with only a single corner of a fastener during torque application, this configuration providing dramatically increased ultimate torque when the wrench is used in a torque application, and at the same time providing support for the fastener when the wrench is ratcheted in a reverse rotation direction for speed wrench applications.

We claim:

1. An open-end speed wrench for use in torque applying forward rotation and ratcheting reverse rotation with a fastener having a plurality of substantially flat sides each having the same side dimension and intersecting at a plurality of corners, the fastener having an across sides dimension, said wrench comprising: a wrenching head including two jaws and a throat interconnecting said jaws, said jaws respectively including short and long driving surfaces each shorter than the side dimension and respectively defining first and second driving planes spaced apart a predetermined distance slightly greater than the across sides dimension and respectively disposed for driving engagement with opposed sides of the fastener, said throat including a generally flat first surface portion adjacent to said short driving surface and inclined with respect thereto at a predetermined angle of at least approximately 120° and having a length substantially 0.29 times said predetermined distance, said first surface portion extending from a first end between said driving planes to a second end spaced from said short driving surface and disposed on the opposite side of said first driving plane from said long driving surface, said throat including means for defining a recessed second surface portion extending from said first surface portion to said long driving surface and shaped and dimensioned so as to remain spaced in use, from an associated fastener which is engaged with said driving surfaces and said first surface portion.

2. The wrench of claim 1, wherein each of said driving surfaces is a substantially flat planar surface.

3. The wrench of claim 1, wherein said driving surfaces converge in a direction away from said throat at an angle of approximately 3°.

4. The wrench of claim 1, wherein said predetermined angle is no greater than 140°.

5. The wrench of claim 1, wherein said wrenching head is of unitary one-piece construction.

6. The wrench of claim 1, and further comprising means accommodating relative movement of said jaws for varying the distance between said driving surfaces.

7. The wrench of claim 1, and further comprising a short arcuate recess formed in one of said jaws between said one driving surface and said first surface portion.

8. The wrench of claim 1, wherein said predetermined angle is approximately 123°.

9. The wrench of claim 1, wherein said first surface portion has a length approximately one-half the side dimension.

10. The end wrench of claim 1, wherein said second surface portion is arcuate in shape.

11. The wrench of claim 6, wherein at least said second driving surface has a plurality of serrations formed therein.

12. The wrench of claim 11, wherein each of said serrations includes an asymmetrical recess formed in said driving surface, said recess including two substantially planar portions disposed substantially perpendicular to each other and respectively disposed at angles of approximately 30° and 60° with respect to said driving surface.

13. The wrench of claim 11, wherein each of said driving surfaces has serrations formed therein.

* * * * *